US009004660B2

(12) United States Patent
Izawa et al.

(10) Patent No.: US 9,004,660 B2
(45) **Date of Patent: *Apr. 14, 2015**

(54) INK SUPPLY DEVICE FOR INKJET RECORDING APPARATUS

(75) Inventors: Hideo Izawa, Chiba (JP); Akira Ishikawa, Chiba (JP); Wataru Itabashi, Chiba (JP)

(73) Assignee: Miyakoshi Printing Machinery Co., Ltd., Narashino-shi, Chiba (JP)

( * ) Notice: Subject to any disclaimer, the term of this patent is extended or adjusted under 35 U.S.C. 154(b) by 2 days.

This patent is subject to a terminal disclaimer.

(21) Appl. No.: 13/134,898

(22) Filed: Jun. 20, 2011

(65) Prior Publication Data

US 2012/0001988 A1 Jan. 5, 2012

(30) Foreign Application Priority Data

Jun. 30, 2010 (JP) ..... 2010-150370

(51) Int. Cl.
*B41J 2/175* (2006.01)

(52) U.S. Cl.
CPC ..... *B41J 2/175* (2013.01); *B41J 2/17513* (2013.01); *B41J 2/17596* (2013.01)

(58) Field of Classification Search
USPC ..... 347/85, 84, 22
See application file for complete search history.

(56) References Cited

U.S. PATENT DOCUMENTS

| | | | | |
|---|---|---|---|---|
| 7,033,005 | B2 * | 4/2006 | Nakamura | 347/85 |
| 7,300,143 | B2 * | 11/2007 | Slotto et al. | 347/86 |
| 2002/0135645 | A1 | 9/2002 | Barinaga et al. | |
| 2003/0128259 | A1 | 7/2003 | Leibman et al. | |
| 2006/0209142 | A1 * | 9/2006 | Kachi | 347/85 |
| 2009/0295881 | A1 * | 12/2009 | Tasaka et al. | 347/85 |
| 2010/0039460 | A1 * | 2/2010 | Delueg | 347/7 |

FOREIGN PATENT DOCUMENTS

| | | | | |
|---|---|---|---|---|
| JP | 2003 019790 A | | 1/2003 | |
| JP | 2003019790 A | * | 1/2003 | B41J 2/01 |
| JP | 2007 245615 A | | 9/2007 | |
| WO | WO 2007/042080 A1 | | 4/2007 | |

OTHER PUBLICATIONS

European Patent Office Search Report mailed Sep. 8, 2011 (7 sheets).

* cited by examiner

*Primary Examiner* — Matthew Luu
*Assistant Examiner* — Lily Kemathe
(74) *Attorney, Agent, or Firm* — Flynn, Thiel, Boutell & Tanis, P.C.

(57) ABSTRACT

An ink supply device for an inkjet recording apparatus including a back pressure tank 21, a distribution tank 12, a plurality of ink opening/closing electromagnetic valves 13, and a plurality of recording heads 14, in which the distribution tank 12 is connected to the back pressure tank 21 via an ink supply path 24, the plurality of ink opening/closing electromagnetic valves 13 is directly attached to the distribution tank 12 while being connected to the plurality of recording heads 14 via a distribution supply pipe 15 and the distribution tank 12 contains a humidification heater 71 for humidifying ink and a temperature sensor 72.

4 Claims, 3 Drawing Sheets

INK SUPPLY DEVICE FOR INKJET RECORDING APPARATUS

TECHNICAL FIELD

The present invention relates to an ink supply device for controlling the viscosity of ink flowing through a plurality of recording heads in an inkjet recording apparatus.

BACKGROUND ART

Conventionally, as an ink supply device for an inkjet recording apparatus having a plurality of recording heads, an inkjet recording apparatus having the following configuration (see FIG. 3) has been known.

More specifically, in the inkjet recording apparatus, ink is self-supplied by being discharged to individual heads 151 from an intermediate tank 131 via a supply valve 133, a common flow path 134, a distributor 141, and an individual head supply path 145 during recording.

The ink is sent by a liquid-sending pump 122 from an ink tank 111 via a replenishment flow path 121 when a bulge detection sensor 132 determines that replenishment is required, and is replenished by a predetermined amount to a replenishment valve 123 and the intermediate tank 131.

The distributor 141 provided halfway in the common flow path 134 is provided to make a flow path resistance of ink to be supplied to the individual heads 151 constituting a recording head 150 uniform and functions as a supply source for a short time.

When the recording head 150 is recovered, an atmosphere communication shutoff valve 143 disposed in an upper part of the distributor 141 is opened, to reverse the liquid-sending pump 122 and slightly suck air in the distributor 141 serving as a part of an ink flow path, and is closed.

Then, the ink is sent by rotating the liquid-sending pump 122 forward, and is extruded by a nozzle of the individual head 151 selected by the individual head valve 146 via a replenishment valve 125 and a pressure flow path 124 for bypassing the intermediate tank 131.

After dripping of the ink from the nozzle of the individual head 151 is stopped, a nozzle surface is wiped by a wiper blade 161 disposed on a maintenance stand 160.

An air vent flow path 171 having an air vent valve 144 is installed from the upper part of the distributor 141, and air is discharged from the flow path during initial introduction of the ink and when air is mixed into an ink supply path (see Patent Document 1).

Conventionally, the following has been known as an inkjet recording apparatus for controlling the viscosity of ink flowing through a recording head.

More specifically, an inkjet recording apparatus in which each of the recording head, a tank, and a supply pipe is provided with a cartridge heater or a heater while being provided with a first temperature sensor, a second temperature sensor, and a third temperature sensor, and a temperature control unit controls each of the temperatures of the recording head, the tank, and the supply pipe to a most suitable temperature has been known (see Patent Document 2).

PRIOR ART DOCUMENTS

Patent Documents

Patent Document 1 Japanese Patent Application Laid-Open Publication No. 2007-245615

Patent Document 2 Japanese Patent Application Laid-Open Publication No. 2003-19790

SUMMARY OF THE INVENTION

Problems that the Invention is to Solve

When the cartridge heater, the heater, and the first, second, and third temperature sensors, as discussed in The above-mentioned Patent Document 2, are applied to the inkjet recording apparatus discussed in the above-mentioned Patent Document 1, the cartridge heater, the heater, and the first, second, third temperature sensors are required to be incorporated into each of the intermediate tank 131, the common flow path 134, the distributor 141, each of the individual head supply paths 145, the individual head valves 146, and the individual heads 151 in the inkjet recording apparatus discussed in the above-mentioned Patent Document 1.

Therefore, the number of heaters and a control area are increased. Therefore, there are problems that it is difficult to make temperatures of the units uniform, defective temperature control may easily occur by a failure or the like, and the component cost is also increased.

The present invention has been made to solve the above-mentioned problem.

More specifically, the present invention is directed to providing, in an inkjet recording apparatus including a plurality of recording heads, an ink supply device for the inkjet recording apparatus capable of efficiently heating ink flowing through the recording heads to control the viscosity of the ink.

Means for Solving the Problems

The invention (1) provides an ink supply device for an inkjet recording apparatus including a back pressure tank, a distribution tank, a plurality of ink opening/closing electromagnetic valves, and a plurality of recording heads, and in which the distribution tank is connected to the back pressure tank via an ink supply path, the plurality of ink opening/closing electromagnetic valves is directly attached to the distribution tank while being connected to the plurality of recording heads via a distribution supply pipe, in which the distribution tank contains a heater for heating the ink and a temperature sensor.

The invention (2) provides the ink supply device for the inkjet recording apparatus as set forth in (1), in which each of the distribution supply pipes is a heater-equipped distribution supply pipe, and includes a temperature sensor.

According to the invention as set forth in (1), a distribution tank 12 contains a heater 71 for heating ink and a temperature sensor 72. Therefore, ink in the distribution tank 12 (e.g., ink to be supplied to each of recording heads 14) can be controlled to a predetermined temperature. Therefore, the viscosity of the ink can be kept at a predetermined viscosity.

A distribution tank may only contain one heater and one temperature sensor. Therefore, the component cost can be suppressed.

According to the invention as set forth in (2), each of distribution supply pipes is a heater-equipped distribution supply pipe while including a temperature sensor. Therefore, the temperature of ink passing in the distribution supply pipes can also be controlled to a predetermined temperature for each of the tube heater-equipped distribution supply pipe 15. Therefore, the viscosity of the ink can be kept to a predetermined viscosity.

BEST MODE FOR CARRYING OUT THE INVENTION

An ink supply device for inkjet recording apparatus according to an embodiment of the present invention will be described in detail below with reference to FIGS. 1, 2 (A) and 2(B).

Figure 1:
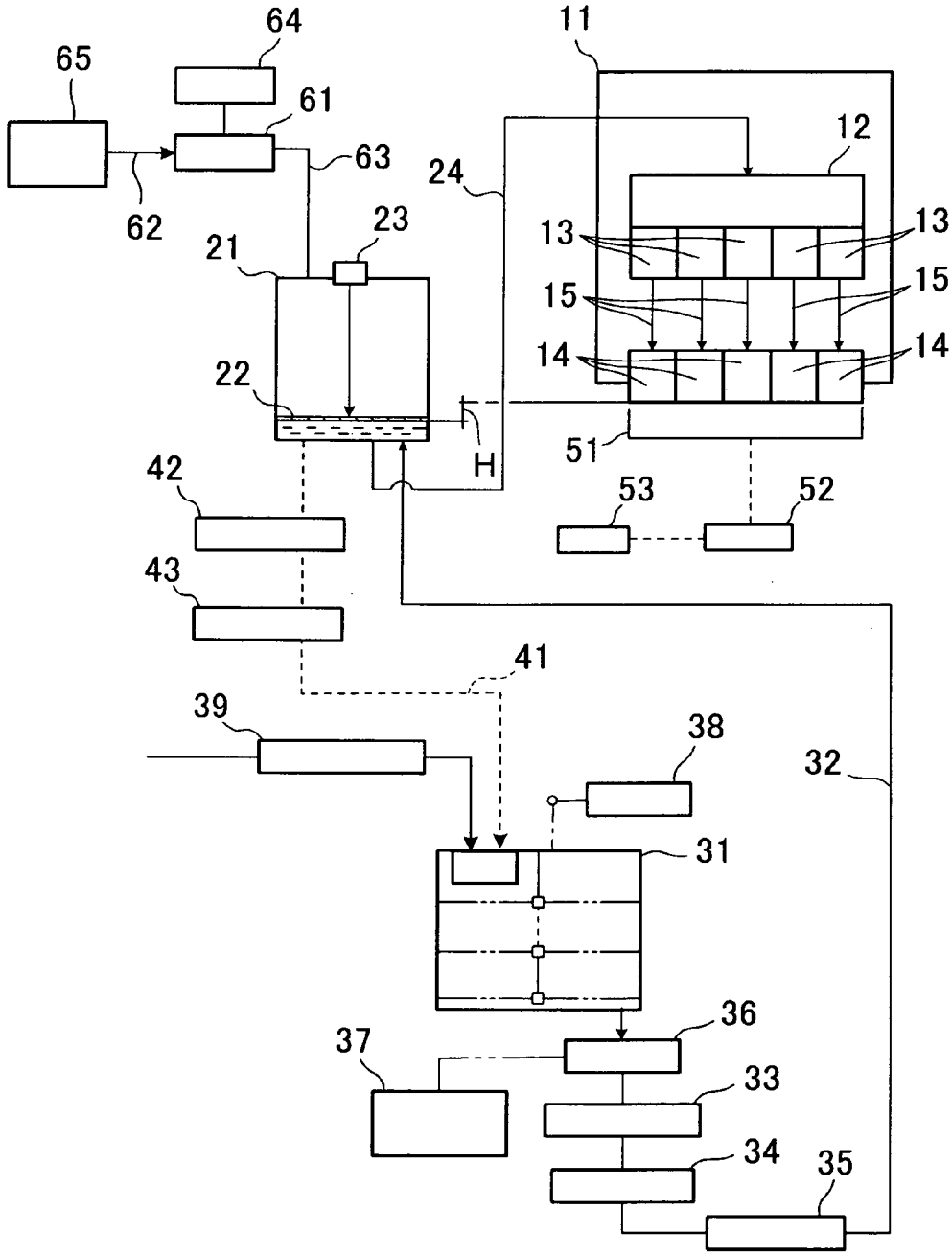
FIG. 1 is an illustration schematically illustrating an ink supply system in an ink supply device for an inkjet recording apparatus according to an embodiment of the present invention.

As illustrated in FIG. 1, an ink supply device for an inkjet recording apparatus according to an embodiment of the present invention includes a head box 11, a back pressure tank 21, a main tank 31, an air switching three-port electromagnetic valve 61, a compressed air supply path 62, an air path 63, and a compressed air supply source 65 for supplying compressed air to the air switching three-port electromagnetic valve 61 via the compressed air supply path 62.

The head box 11 accommodates a distribution tank 12, a plurality of (five) ink opening/closing electromagnetic valves 13 directly attached to the distribution tank 12, a plurality of (five) recording heads 14, and a plurality of (five) tube heater-equipped distribution supply pipes (heater-equipped distribution supply pipes) 15, and the ink opening/closing electromagnetic valves 13 and the recording heads 14 are respectively connected to each other by the tube heater-equipped distribution supply pipes 15.

Figure 2:
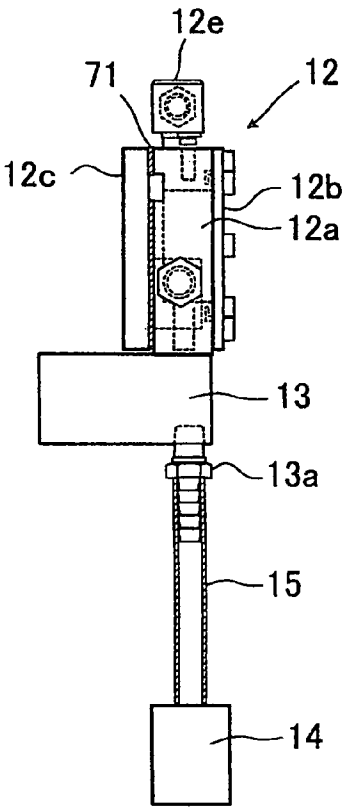
FIG. 2 illustrates a distribution tank illustrated in FIG. 1, where FIG. 2 (A) is a front view, and FIG. 2 (B) is a left side view of the FIG. 2 (A).
Figure 2:
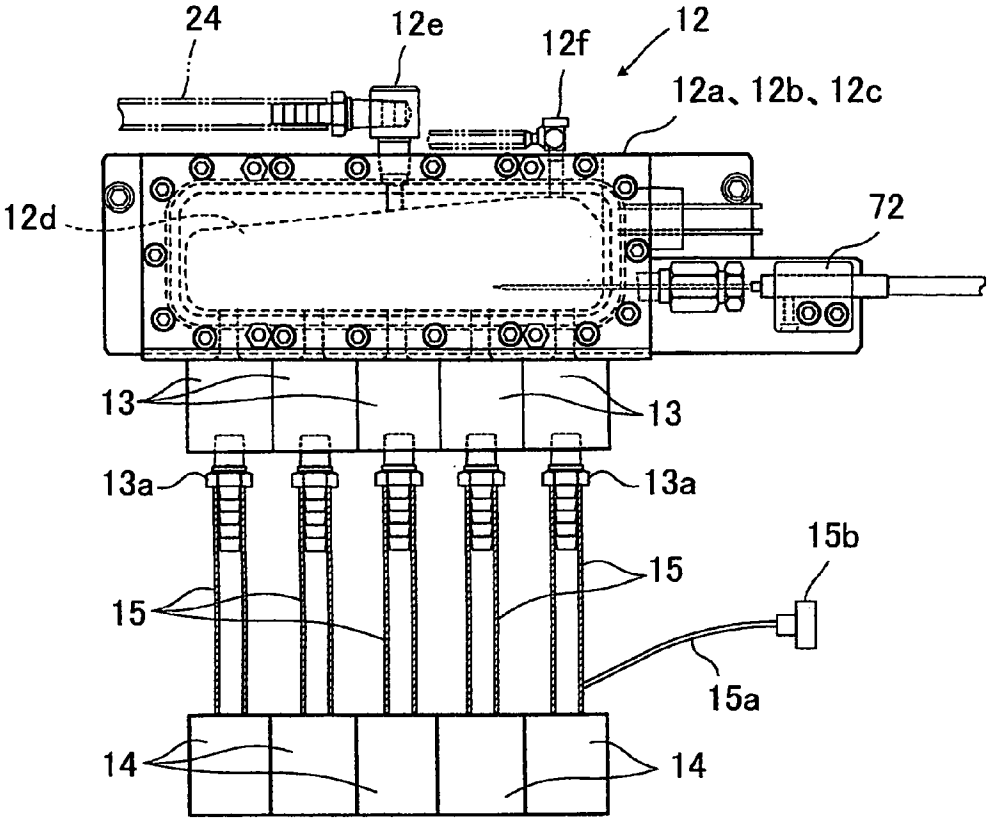
Figure 3:
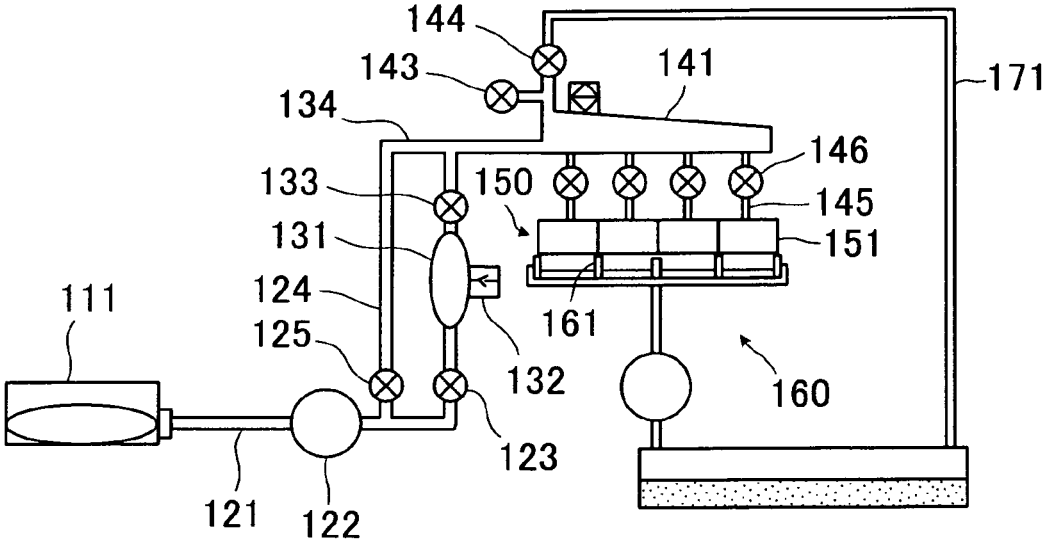
Fig.3 Prior Art
FIG. 3 is an illustration of an inkjet recording apparatus including a conventional plurality of recording heads.

As illustrated in FIG. 2 (A) and FIG. 2 (B), a connector 15*b* is attached to the tube heater-equipped distribution supply pipe 15 via a lead wire 15*a*, and is connected to a power supply (not illustrated).

A temperature sensor for measuring a temperature of ink in the tube heater-equipped distribution supply pipe 15 is provided, which is not illustrated, and the temperature sensor (e.g., a thermocouple) is connected to a control device (not illustrated).

Distribution supply pipe insertion units 13*a* (see FIG. 2 (A) and FIG. 2 (B)) into which the tube heater-equipped distribution supply pipes 15 are to be inserted are respectively attached to the ink opening/closing electromagnetic valves 13.

An electromechanical converter such as a piezoelectric element is used for the inkjet recording apparatus. A control device (not illustrated) drives the electromechanical converter such as the piezoelectric element, and an ink droplet is discharged from each of the recording heads 14, and is recorded on a recorded member such as paper (not illustrated).

As illustrated in FIG. 2 (A) and FIG. 2 (B), a transparent cover 12*b* and a plate 12*c* are attached to the distribution tank 12 with a frame 12*a* sandwiched therebetween, and a space 12*d* in the frame 12*a* is filled with ink.

One end of the ink supply path 24, described below, is connected to an ink supply path connection member 12*e* (see FIG. 2 (A) and FIG. 2 (B)) attached to the top of the frame 12*a* in the distribution tank 12.

An air vent member 12*f* for removing air in the frame 12*a* is connected to the top of the frame 12*a* in the distribution tank 12.

A plate-shaped rubber heater (heater) 71 is attached in a sandwiched state between the frame 12*a* and the plate 12*c* in the distribution tank 12, and a temperature sensor 72 (e.g., a thermocouple) for measuring a temperature of ink in the space 12*d* is attached to the frame 12*a* or the plate 12*c*.

The temperature sensor 72 and a temperature sensor (not illustrated) in the above-mentioned tube heater-equipped distribution supply pipe are connected to a control device (not illustrated), and the plate-shaped rubber heater (heater) 71 and each tube heater are controlled to be turned on or off so that the temperature of the ink is controlled to be constant.

As illustrated in FIG. 1, the back pressure tank 21 contains a float 22 that floats in contact with a substantially whole surface of a liquid surface of ink stored therein.

The back pressure tank 21 is provided with a liquid surface detector 23 for detecting the height of the liquid surface of the ink via the float 22.

There is provided an ink supply path 24 for connecting the bottom of the back pressure tank 21 and the distribution tank 12.

The compressed air supply path 62 to which compressed air is supplied from the exterior, the air switching three-port electromagnetic valve 61 to which the compressed air supply path 62 is connected, and an air filter 64 connected to the air switching three-port electromagnetic valve 61 are arranged above the back pressure tank 21, and the air switching three-port electromagnetic valve 61 communicates with an upper part inside of the back pressure tank 21 via the air path 63.

The air switching three-port electromagnetic valve 61 is used by being switched between the time of recording by the recording head 14 and the time of pressure purging, as described below.

A main tank supply pump 39 supplies ink to the top of a main tank 31, and the top of the main tank 31 communicates with the atmosphere via an air filter 38.

The bottom of the back pressure tank 21 and the bottom of the main tank 31 are connected to each other via an ink replenishment path 32.

An ink replenishment pump 33 for replenishing ink from the main tank 31 according to a consumed amount of ink in the back pressure tank 21, an ink replenishment electromagnetic valve 34, a replenishment ink filter 35, and a deaeration module 36 are intermediated in the ink replenishment path 32 for connecting the back pressure tank 21 and the main tank 31.

A deaeration controller 37 is connected to the deaeration module 36.

An ink return path 41 connects the bottom of the back pressure tank 21 and the top of the main tank 31, and a back pressure tank return electromagnetic valve 42 and a back pressure tank return pump 43 are provided halfway in an ink return path 41.

A pan 51 is arranged at a position opposing the plurality of recording heads 14 below the plurality of recording heads 14, and a waste tank 52 connected to the pan 51 and a waste collection unit 53 connected to the waste tank 52 are provided.

During recording, the air switching three-port electromagnetic valve 61 is switched to a position open to the atmosphere by an operation of a control device (not illustrated). Therefore, the back pressure tank 21 communicates with the atmosphere via the air filter 64 so that the supply of the compressed air is stopped.

The control device (not illustrated) controls the operations of the ink replenishment pump 33 and the ink replenishment electromagnetic valve 34 using a detected value of the liquid surface detector 23.

More specifically, when ink in the back pressure tank 21 is supplied to the recording heads 14 via the ink supply path 24, the distribution tank 12, the ink opening/closing electromagnetic valves 13, and distribution supply pipes 15 so that a liquid surface of the ink in the back pressure tank 21 is reduced, the ink replenishment electromagnetic valve 34 is opened in response to a signal from the liquid surface detector 23 that has detected the reduction of the liquid surface at this time while the ink replenishment pump 33 is operated to replenish the ink to the back pressure tank 21 from the main tank 31.

When an amount of the replenished ink becomes a predetermined amount, and the liquid surface of the ink in the back pressure tank 21 becomes a predetermined position, the ink replenishment pump 33 is stopped in response to a signal from the liquid surface detector 23 for detecting the liquid surface of the ink while the ink replenishment electromagnetic valve 34 is closed so that the liquid surface of the ink in the back pressure tank 21 is always maintained at a predetermined height.

Therefore, a positional relationship in a height direction between the liquid surface of the ink in the back pressure tank 21 and a head surface of the recording head 14 is constant so that a predetermined position head H is kept.

A function during pressure purging will be described below.

During recording, the air switching three-port electromagnetic valve 61 that is switched so that the inside of the back pressure tank 21 is open to the atmosphere is switched by an operation of the control device (not illustrated) so that compressed air is supplied to an upper part inside of the back pressure tank 21 during pressure purging.

By this switching operation, the opening of the air switching three-port electromagnetic valve 61 to the atmosphere is interrupted.

Thus, the compressed air supplied to the upper part inside of the back pressure tank 21 causes the liquid surface of the ink in the back pressure tank 21 to be pressurized via the float 22.

The recording head 14 that is defective in discharge is designated by a switch in a control device (not illustrated) so that only the ink opening/closing electromagnetic valve 13 corresponding to the designated recording head 14 is opened.

Consequently, pressurized ink is supplied to only the designated recording head 14, bubbles and thickened ink are discharged to the pan 51 from a nozzle hole.

Waste ink discharged to the pan 51 is recovered in the waste liquid tank 52, and is collected in the waste collection unit 53.

The ink supply device for inkjet recording apparatus according to the embodiment of the present invention has the following effect.

Ink is pressurized by compressed air, only the ink opening/closing electromagnetic valve 13 corresponding to the designated recording head 14 is opened, and pressure purging is enabled for only the designated recording head 14.

The pressurization at this time is by compressed air. Therefore, there is no pulsation as in pressurization by a pump, and leakage of ink from a piping joint unit can be reduced.

Each of the ink opening/closing electromagnetic valves 13 is directly attached to the distribution tank 12. Therefore, there is no leakage of ink from the periphery of each of the ink opening/closing electromagnetic valves 13 during the pressure purging.

In the ink supply device for the inkjet recording apparatus according to the embodiment of the present invention, the distribution tank 12 contains the heater 71 for heating ink and the temperature sensor 72. Therefore, ink in the distribution tank 12 (e.g., ink to be supplied to each of the recording heads 14) can be controlled to a predetermined temperature, and even each of the ink opening/closing electromagnetic valves 13 directly attached to the distribution tank 12 is humidified and temperature-controlled by thermal conduction. Therefore, the viscosity of the ink can be kept to a predetermined viscosity.

The distribution tank 12 may only contain one heater 71 and one temperature sensor 72. Therefore, the component cost can be suppressed.

The inkjet recording apparatus includes temperature sensors (not illustrated) so that the temperature of ink passing in the tube heater-equipped distribution supply pipes 15 can also be controlled to a predetermined temperature for each of the tube heater-equipped distribution supply pipes 15. Therefore, the viscosity of the ink can be kept to a predetermined viscosity.

While the present invention has been described above, the present invention is not limited to the above-mentioned embodiment. Various modifications can be made as long as it suits its purpose.

For example, a temperature sensor in a distribution tank or a distribution supply pipe is not limited to a thermocouple. Various thermistors can be used.

While an inkjet recording apparatus of a piezoelectric inkjet type using an electromechanical converter such as a piezoelectric element is illustrated in the present embodiment, the present invention is also naturally applicable to an inkjet recording apparatus of a thermal inkjet type.

INDUSTRIAL APPLICABILITY

The present invention provides an ink supply device for an inkjet recording apparatus capable of efficiently heating ink to control the viscosity of ink flowing through a recording head. However, the present invention is widely used in various ways as an apparatus for performing recording using an inkjet method on a recording medium as long as its principle is employed.

DESCRIPTION OF REFERENCE NUMERALS

11 head box
12 distribution tank
12*a* frame
12*b* cover
12*c* plate
12*d* space
12*e* ink supply path connection member
12*f* air vent member
13 ink opening/closing electromagnetic valve
13*a* distribution supply pipe insertion unit
14 recording head
15 tube heater-equipped distribution supply pipe (heater-equipped distribution supply pipe)
15*a* lead wire
15*b* connector
21 back pressure tank
22 float
23 liquid surface detector
24 ink supply path
31 main tank
32 ink replenishment path

33 ink replenishment pump
34 ink replenishment electromagnetic valve
35 replenishment ink filter
36 deaeration module
37 deaeration controller
38 air filter
39 main tank supply pump
41 main return path
42 back pressure tank return electromagnetic valve
43 back pressure tank return pump
51 pan
52 waste liquid tank
53 waste collection unit
61 air switching three-port electromagnetic valve
62 compressed air supply path
63 air path
64 air filter
65 compressed air supply source
71 plate-shaped rubber heater (heater)
72 temperature sensor
H position head

The invention claimed is:

1. An ink supply device for an inkjet recording apparatus comprising a back pressure tank, a distribution tank, a plurality of ink opening/closing electromagnetic valves, and a plurality of recording heads, and in which the distribution tank is connected to the back pressure tank via an ink supply path, the plurality of ink opening/closing electromagnetic valves is directly attached to the distribution tank while being connected to the plurality of recording heads via a distribution supply pipe, characterized in that the back pressure tank contains a float that floats in contact with substantially the entire upper liquid surface of ink stored therein;

the back pressure tank is provided with a liquid surface detector for detecting the height of the upper liquid surface of the ink via the float;

an upper part inside of the back pressure tank communicates with the atmosphere via an air path, an air switching three-port electromagnetic valve, and an air filter connected to the air switching three-port electromagnetic valve;

a cover and a plate are attached to the distribution tank with a frame sandwiched therebetween, and a space provided in the flame is filled with ink;

an air vent member for removing air in the frame is connected to a top of the frame in the distribution tank;

a plate-shaped humidification heater is attached in a sandwiched state between the frame and the plate; and a temperature sensor for measuring the temperature of ink in the space is attached to the frame or the plate.

2. The ink supply device of claim 1, characterized in that each of the distribution supply pipes is a heater-equipped distribution supply pipe, and includes a temperature sensor.

3. The ink supply device for an inkjet recording apparatus of claim 1, characterized in that ink in the back pressure tank is supplied to the recording heads via the ink supply path, the distribution tank, the ink opening/closing electromagnetic value, and the distribution supply pipe, and the ink replenishment pump is operated by a signal from the liquid surface detector when the liquid surface of ink in the back pressure bank has been reduced to replenish ink in the back pressure tank from a main tank, thereby maintaining the liquid surface of ink in the back pressure tank at a predetermined height.

4. The ink supply device of claim 3, characterized in that each of the distribution supply pipes is a heater-equipped distribution supply pipe, and includes a temperature sensor.

* * * * *